US009016396B2

(12) United States Patent
Andersson

(10) Patent No.: US 9,016,396 B2
(45) Date of Patent: Apr. 28, 2015

(54) PERCUSSION DEVICE AND ROCK DRILLING MACHINE

(75) Inventor: Kurt Andersson, Tyresö (SE)

(73) Assignee: Atlas Copco Rock Drills AB, Orebro (SE)

( * ) Notice: Subject to any disclaimer, the term of this patent is extended or adjusted under 35 U.S.C. 154(b) by 1187 days.

(21) Appl. No.: 12/311,202

(22) PCT Filed: Sep. 28, 2007

(86) PCT No.: PCT/SE2007/000867

§ 371 (c)(1),
(2), (4) Date: Mar. 20, 2009

(87) PCT Pub. No.: WO2008/041906

PCT Pub. Date: Apr. 10, 2008

(65) Prior Publication Data

US 2009/0308627 A1 Dec. 17, 2009

(30) Foreign Application Priority Data

Oct. 2, 2006 (SE) ..... 0602052

(51) Int. Cl.

| | |
|---|---|
| ***E21B 1/02*** | (2006.01) |
| ***E21B 1/38*** | (2006.01) |
| ***B25D 1/12*** | (2006.01) |
| ***B25D 17/06*** | (2006.01) |
| ***B25D 17/24*** | (2006.01) |

(52) U.S. Cl.

CPC ..... *B25D 17/06* (2013.01); *B25D 17/245* (2013.01); *B25D 2217/0023* (2013.01); *B25D 2250/181* (2013.01); *E21B 1/02* (2013.01)

(58) Field of Classification Search

CPC ..... B25D 9/00; B25D 9/04; B25D 9/06; B25D 11/02; B25D 11/04

USPC ..... 173/128, 135, 201, 162.1

See application file for complete search history.

(56) References Cited

U.S. PATENT DOCUMENTS

| | | | | |
|---|---|---|---|---|
| 1,368,470 | A * | 2/1921 | Ayer | 173/65 |
| 1,865,010 | A * | 6/1932 | Hulshizer | 173/61 |
| 3,788,404 | A * | 1/1974 | Koudelka et al. | 173/211 |
| 4,074,777 | A * | 2/1978 | Andersson et al. | 173/138 |
| 4,102,410 | A * | 7/1978 | Ross | 173/133 |
| 4,114,950 | A * | 9/1978 | Cooper | 299/15 |

(Continued)

FOREIGN PATENT DOCUMENTS

| | | |
|---|---|---|
| EP | 0 389 454 A | 9/1990 |
| EP | 1 157 787 A | 11/2001 |

(Continued)

*Primary Examiner* — Gloria R Weeks

(74) *Attorney, Agent, or Firm* — Mark P. Stone

(57) ABSTRACT

A percussion device (5) for a rock drilling machine (1) including a percussive piston (6; 15) which is reciprocally movable inside a cylinder and an impact receiving element (7;16) with an impact surface (A;A'), against which the percussive piston is arranged to perform strikes in an impact direction for transferring of percussive energy through Shockwaves to a percussive tool. The percussion device is distinguished by the impact receiving element (7; 16) including a Shockwave modifying portion (9; 17) which extends in a direction opposite to the impact direction as seen from a plane (P; P') through the impact surface (A; A'). The invention also concerns a rock drilling machine and a rock drilling rig.

17 Claims, 1 Drawing Sheet

(56) References Cited

U.S. PATENT DOCUMENTS

| | | | | | |
|---|---|---|---|---|---|
| 4,209,070 | A | * | 6/1980 | Sudnishnikov et al. | 173/78 |
| 4,308,926 | A | * | 1/1982 | Montabert | 173/162.1 |
| 4,582,144 | A | * | 4/1986 | Mizutani | 173/14 |
| 5,052,498 | A | * | 10/1991 | Gustafsson et al. | 173/118 |
| 5,083,499 | A | * | 1/1992 | Elvingsson | 92/193 |
| 5,108,400 | A | * | 4/1992 | Appel et al. | 606/79 |
| 5,305,841 | A | | 4/1994 | Beccu | |
| 5,568,839 | A | * | 10/1996 | Campbell | 175/320 |
| 5,685,380 | A | * | 11/1997 | Purcell et al. | 175/215 |
| 5,896,934 | A | * | 4/1999 | Yaniero et al. | 173/132 |
| 5,896,937 | A | * | 4/1999 | Kaneko | 173/211 |
| 5,931,243 | A | | 8/1999 | Beccu | |
| 6,098,723 | A | * | 8/2000 | Yaniero et al. | 173/128 |
| 6,526,852 | B2 | * | 3/2003 | Rahmsdorf et al. | 81/464 |
| 6,976,545 | B2 | * | 12/2005 | Greitmann | 173/104 |
| 7,469,751 | B2 | * | 12/2008 | Gien | 173/15 |
| 7,726,414 | B2 | * | 6/2010 | Berger et al. | 173/201 |
| 2003/0146007 | A1 | * | 8/2003 | Greitmann | 173/48 |
| 2003/0221847 | A1 | | 12/2003 | Funfer | |
| 2005/0056466 | A1 | | 3/2005 | Cosic et al. | |
| 2009/0194336 | A1 | * | 8/2009 | Larsson et al. | 175/296 |
| 2010/0193208 | A1 | * | 8/2010 | Plunkett | 173/135 |

FOREIGN PATENT DOCUMENTS

| | | | |
|---|---|---|---|
| FR | 2 540 418 | A | 8/1984 |
| SE | 432280 | B | 3/1984 |
| SE | 506527 | C2 | 12/1997 |
| WO | WO 97/08421 | A | 3/1997 |
| WO | WO 2004/037493 | A | 5/2004 |
| WO | WO 2004/065755 | A | 8/2004 |
| WO | WO 2006/121386 | A1 | 11/2006 |

* cited by examiner

PERCUSSION DEVICE AND ROCK DRILLING MACHINE

FIELD OF THE INVENTION

The invention concerns a percussion device for a rock drilling machine according to the preamble of claim 1. The invention also concerns a rock drilling machine including such a percussion device.

BACKGROUND OF THE INVENTION

In a previously known percussion device, a percussive piston strikes against a drill steel over a drill shank, whereby is produced a shockwave which is essentially twice as long as the length of the percussive piston. The shockwave moves forwardly in the drill steel with the speed of sound in steel.

The drill string end and thereby the drill bit, which is attached to the string, moves forwardly a distance which depends on the length of the shockwave and the striking speed of the piston. In order to obtain rock crushing in front of the drill bit, the forward movement of the drill bit must be sufficiently great.

Besides, depending on the properties of the rock, certain types of rock require longer strike lengths of the drill bit than other types of rock in order to be effectively disintegrated.

The material in the percussion device and the drill steel, and in particular the steel strength, limits possible piston striking speed. In order to obtain sufficient drill bit displacement, the percussion device thus must be dimensioned such that the percussive piston has a relatively long axial length in order to ensure sufficiently long shockwave length, so that drilling can be effective in various types of rock.

The length of the percussive piston is also dimensioning for the total length of the drilling machine, which makes it a problem to provide drilling machines with smaller dimensions which are for example more suitable for use in more confined spaces.

SUMMARY OF THE INVENTION

It is an aim of the present invention to provide a solution to said problem with the background art and in particular to provide a percussion device which with maintained efficiency can be manufactured with such dimensions that it is better suitable for use also in narrow spaces.

These aims are obtained by a percussion device of the above kind through the features of the characterising part of claim 1.

Hereby is obtained that increased shockwave length can be obtained for transfer to the percussive tool with maintained length of the percussive piston. Expressed inversely, with a radically shortened percussive piston length, a shockwave length can be achieved which corresponds to one obtained in a conventional percussion device with longer percussive piston.

The explanation to this phenomenon is that when the percussive piston strikes against the impact surface, a primary wave in the form of a compression wave advances, in the impact direction, directly in the direction of the percussive tool. At the same time there is produced a tensile wave in the shockwave modifying portion, which tensile wave propagates in the opposite direction, i.e. rearwards.

When this tensile wave reaches the distal end, in relation to the impact surface, of the shockwave modifying portion, the wave turns and becomes a compression wave, which now will propagate in the impact direction forwardly through the shockwave modifying portion, further as a secondary wave through the impact receiving element and continue forwardly in the impact direction for transferring of the percussive energy to the percussive tool.

This means that a secondary wave from the shockwave modifying portion adds to the primary wave which appears directly from the percussive piston, which results in an extended shockwave for transfer to the percussive tool.

Through the invention, the piston can thus be made essentially shorter, and thereby also a percussion device according to the invention can be made essentially shorter without having to go below the shockwave length which is required for crushing rock.

It is preferred that the shockwave modifying portion has a length which is essentially the same as the length of the percussive piston. In that case the secondary wave will essentially directly add to the primary wave, such that, totally seen, a nearly continuous shockwave is obtained for transfer to the percussive tool through the drill steel. The total shockwave in the drill steel thus becomes essentially four times as long as the piston length.

By the cross sectional area of the shockwave modifying portion being about half the cross sectional area of the percussive piston it is achieved, if the same material is used in the respective element, that the amplitude of a total shockwave will be maintained essentially constant over its entire length.

It is preferred that the percussive piston is tubular and surrounds the shockwave modifying portion. This way it will be easier to perform control of the percussive piston in a conventional manner in respect of drive chambers, return chambers etc. for the percussive piston in case of a fluid driven percussion device. This solution also gives more simplified possibilities of bearing support of the piston relative to a housing of a percussion device.

In a preferred embodiment, the shockwave modifying portion has a distal surface, in relation to the impact surface, against which a damping piston rests in order to provide the necessary pressing force in the direction of the rock which is necessary during rock drilling.

The invention also concerns a rock drilling machine which includes a percussive piston according to the above and a rock drilling rig with such a rock drilling machine, whereby the corresponding advantages are achieved.

BRIEF DESCRIPTION OF THE DRAWINGS

The invention will now be described in greater detail at the background of embodiments and with reference to the annexed drawings, wherein.

DETAILED DESCRIPTION OF THE INVENTION

Figure 1:
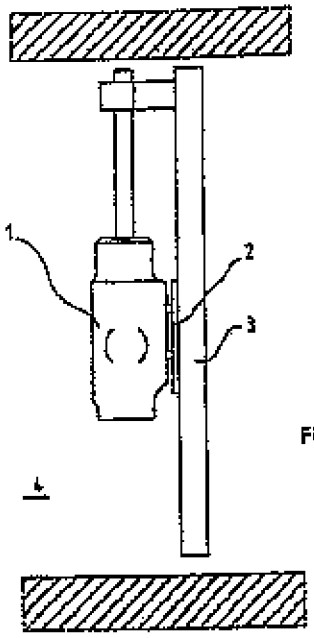
FIG. 1 diagrammatically shows a drilling machine according to the invention during a drilling process in a narrow space, FIG. 2 diagrammatically shows a percussion device for a rock drilling machine according to the invention in a cross sectional view, and FIG. 3 diagrammatically shows an alternatively embodied percussion device according to the invention.

In FIG. 1 is shown a drilling machine 1 according to the invention in a process of drilling vertically into the ceiling of a tunnel 4 with very reduced height, which makes it a problem to use conventional, relatively long drilling machines.

The rock drilling machine 1 is as usual supported by a feed beam 3, whereon it is movable over a slide 2. The feed beam is in a conventional manner supported by a not shown drilling rig through conventional means.

Figure 2:
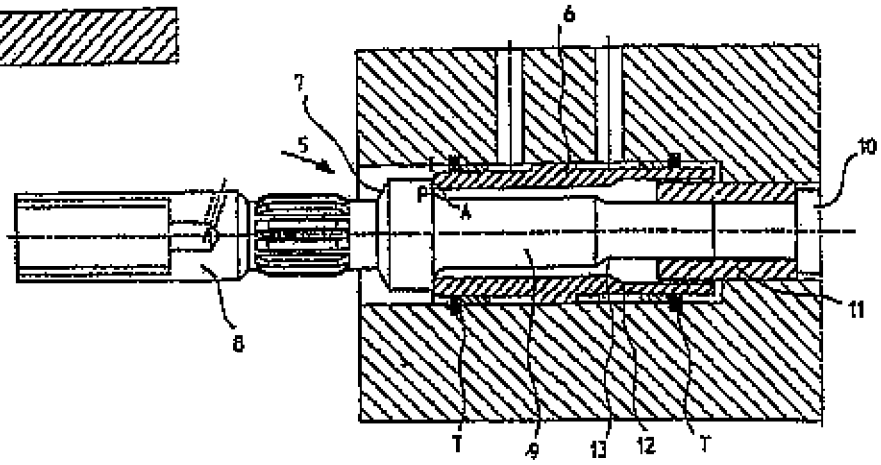

In FIG. 2 is shown a percussion device 5 in an axial section. The percussion device 5 includes a tubular percussive piston 6, which is reciprocally movable in order to perform high-energy strikes against an impact receiving element 7, in this case in the form of an intermediate block.

The invention is also suitable when the percussive piston strikes against other types of impact receiving elements such as a particularly constructed drill shank or even directly on to the end of a particularly constructed drill string end.

The impact receiving element 7 is constructed such that it exhibits a ring-shaped impact surface A, against which the tubular percussive piston 6 strikes with its also ring-shaped impact surface. In the shown embodiment, the impact receiving element 7 is constructed "mushroom-shaped", with the element corresponding to the hat of the mushroom form being comprised of an extended portion, which on the underside of the "hat" has an impact surface A, and on the upper side of the "hat" has a contact surface for contacting against and for transferring of shockwave energy into a per se known drill shank 8 for further transfer of the shockwave to a rock crushing tool (not shown, but threads for connection are shown with interrupted lines).

The mushroom-shaped impact receiving element 7 has further a "mushroom-stem like" shockwave modifying portion 9, which extends from a plane P through the impact surface A in the opposite direction to the impact direction and with a length that essentially corresponds to the length of the percussive piston 6.

Against the distal end surface of the shockwave modifying portion 9, in respect to the impact surface, is lying a damping piston 10, which by means of not shown damping fluid contributes to take up unwanted reflexes from the drill string and to ensure that sufficient feed force is transferred to the drill tool.

At its inner, or rear, part, the shockwave modifying portion 9 is axially movably supported in a support sleeve 11, which in this embodiment also supports a contacting portion of the damping piston 10 in this area.

The function of the percussion device 5 is as follows: When the percussive piston 6 strikes against an impact surface A of the impact receiving element 7, a compression wave goes down into the drill steel over the drill shank 8, but at the same time a tensile wave goes upwardly into the shockwave modifying portion 9 of the impact receiving element 7.

When the tensile wave reaches the distal end, in respect of the impact surface, of the shockwave modifying portion, this tensile wave turns and is transferred to a compression wave, which propagates in the impact direction in the shockwave modifying portion 9, then continues past the plane P through the impact surface A and adds as a secondary wave to the primary wave in the drill shank 8 and inside the not shown drill steel.

The result will in this case be that the shockwave transferred to the drill tool will be essentially twice as long as it would have been with a conventionally constructed percussion device with a percussive piston of the same length as the percussive piston 6. As a result it is thus possible to provide relatively very short percussion devices with up to half as short percussive piston as in conventional percussion devices without having to go below a shockwave length which is necessary in order to achieve effective rock crushing.

The percussive piston 6 can be controlled in the percussion device 5 by in per se conventional methods and with conventional means constructed for the co-operation of the percussive piston 6 with the cylindrical bore of the percussion device 5. This can be made in a plurality of ways that can be easily understood by the person skilled in the art without inventive skill, and is therefore not described in more detail here.

Seals in different positions applied against the impact receiving element, against the percussive piston and against the damping piston are indicated with T.

12 indicates a portion inwardly of the tubular percussive piston, where a cross section area change occurs. This as well as a corresponding area 13 of the shockwave modifying portion 9 is provided in order to ensure a sufficient space for the axially acting support sleeve 11. These regions do not effect the shockwave propagation in the elements to any appreciable extent.

Figure 3:
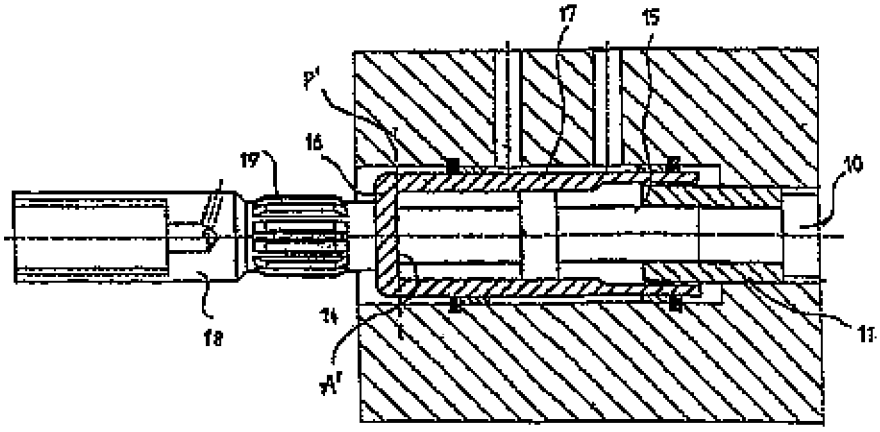

The invention can be modified within the scope of the following claims and an example of this is indicated in FIG. 3, where an alternative percussion device 14 is shown, wherein a short percussive piston 15 is movable reciprocally inside a cylindrical space formed by the impact receiving element 16, which exhibits a shockwave modifying portion 17 in tubular form and thus forms a path for the percussive piston 15. A' indicates an impact surface and P' a plane through A'.

A damping piston 10, similar to that shown in FIG. 2, is arranged to engage the rear end of the percussive piston 15, A sleeve 11, also similar to that shown in FIG. 2, supports the percussive piston 15.

Also in this case the shockwave modifying portion 17 has an axial length essentially corresponding to the length of the percussive piston 15 and the effect in a rear shank 18 and further into a drill tool (not shown) will also in this case be a shockwave which is more extended over time acting onto the drill tool. Splines for possible connection to a rotational unit are indicated with 19.

The reciprocal movement of the percussive piston 15 can be effected by pressurizing in axial positions in a manner that can be easily understood by the person skilled in the art and are therefore not described in more detail here.

The invention can be modified further, for example by constructing the shockwave modifying portion 19 differently, for example with its length being different from the length of the percussive piston. In such cases the superposition of a primary wave and a secondary wave will occur in respect of each other can be modified in order to obtain particular properties that could be valuable in certain applications.

It could be noted that with an axial length of the shockwave modifying portion which is shorter than the percussive piston, the secondary wave will add to the primary wave during the time when the primary wave is still propagating. This could however be problematic, since parameters such as striking speeds, shockwave levels and the like are limited by the strength of the material.

With a length of a shockwave modifying portion exceeding the length of the percussive piston, the secondary wave will occur in the area of the impact surface after the end of the primary wave.

There are also possibilities of constructing the respective cross sectional areas of the percussive piston and of the shockwave modifying portion otherwise than what is described above, even if what is shown, where the cross sectional surface of the percussive piston is essentially twice as great as the one of the shockwave modifying portion cross sectional area, is preferred. Besides it could be said that the respective amplitudes of the primary and the secondary waves depend on the relationship between the cross sectional areas, such that a relatively greater cross sectional area of the shockwave modifying portion gives higher amplitude of the secondary wave.

The damping arrangement can also be constructed differently and could as an example be arranged in such a way that it is arranged at the "mushroom hat like" part of the impact receiving element 7 in FIG. 2, wherein a damping piston would not have to contribute to increasing the axial length of the percussive piston, and the percussion device thus could be made shorter than what is the case in respect of the embodiment in FIG. 2.

The impact receiving element can include a shockwave modifying portion by the latter being an integral part thereof or by it later being intimately interconnected therewith by means of any suitable coupling method.

The invention claimed is:

1. Percussion device for a rock drilling machine including a percussive piston which is reciprocally movable inside a cylinder and an impact receiving element with an impact surface (A;A'), against which the percussive piston is arranged to perform strikes in an impact direction towards a percussive tool for transferring percussive energy through shockwaves to said a percussive tool, wherein the impact receiving element includes a shockwave modifying portion which extends in a direction opposite to the impact direction as seen from a plane (P;P') through the impact surface (A;A'), said shockwave modifying portion being formed integrally with said impact receiving element, said impact receiving surface being provided at the forward end of said shockwave modifying portion, and a damping piston arranged to engage the rear end of said shockwave modifying portion, wherein the shockwave modifying portion has a length, as seen from said plane, which is essentially the same as the length of the percussive piston.

2. Percussion device according to claim 1, wherein all portions of the shockwave modifying portion along the length thereof have a cross sectional area which is essentially half of the cross sectional area of the percussive piston.

3. Percussion device according to claim 2, wherein the shockwave modifying portion has an essentially circular cross section.

4. Percussion device according to claim 2, wherein the percussive piston has an essentially circular cross section.

5. Percussion device according to claim 1, wherein the shockwave modifying portion has an essentially circular cross section.

6. Percussion device according to claim 1, wherein the percussive piston is tubular and surrounds the shockwave modifying portion.

7. Percussion device according to claim 1, wherein the percussive piston has an essentially circular cross section.

8. Percussion device according to claim 1, including means for providing bearing support for the shockwave modifying portion in a distal region, as seen from said plane.

9. Percussion device according to claim 1, including means for providing bearing support of the impact receiving element in a position forwardly in the impact direction as seen from said plane.

10. Percussion device according to claim 1, wherein said damping piston provides means for exerting an axial damping force against said rear end of the shockwave modifying portion.

11. Percussion device according to claim 1, wherein the impact receiving element is an intermediate block, positioned between a drill tool adaptor and the percussive piston.

12. Percussion device according to claim 1, wherein the impact receiving element is a took shank, in particular a drill shank.

13. Percussion device according to claim 1, including means for driving the percussive piston with pressure fluid.

14. Rock drilling machine including a percussion device according to claim 1.

15. Rock rig including a rock drilling machine according to claim 14.

16. Percussion device for a rock drilling machine including a percussive piston which is reciprocally movable inside a cylinder and an impact receiving element with an impact surface (A;A'), against which the percussive piston is arranged to perform strikes in an impact direction towards a percussive tool for transferring percussive energy through shockwaves to said a percussive tool, wherein the impact receiving element includes a shockwave modifying portion which extends in a direction opposite to the impact direction as seen from a plane (P;P') through the impact surface (A;A'), said shockwave modifying portion being formed integrally with said impact receiving element, wherein the shockwave modifying portion has a length, as seen from said plane, which is essentially the same as the length of the percussive piston, wherein the percussive piston has an essentially circular cross section, and wherein the shockwave modifying portion is tubular and surrounds the percussive piston.

17. Percussion device according to claim 16, including a damping piston arranged to engage the rear end of the percussive piston.

* * * * *

UNITED STATES PATENT AND TRADEMARK OFFICE

CERTIFICATE OF CORRECTION

PATENT NO. : 9,016,396 B2
APPLICATION NO. : 12/311202
DATED : April 28, 2015
INVENTOR(S) : Kurt Andersson It is certified that error appears in the above-identified patent and that said Letters Patent is hereby corrected as shown below:

In the Specification

Column 4, Line 24: Delete “,”, and substitute --.--.

In the Claims

Column 5, Line 20 (Claim 1, Line 7): Delete “a”.

Column 6, Line 32 (Claim 16, Line 7): Delete “a”.

Signed and Sealed this
Twenty-eighth Day of July, 2015

Michelle K. Lee

Michelle K. Lee
*Director of the United States Patent and Trademark Office*